United States Patent [19]

Fabbri et al.

[11] 3,953,168

[45] Apr. 27, 1976

[54] DYEING PROCESS

[75] Inventors: Sergio Fabbri, Basel; Josef Frauenknecht, Therwil, both of Switzerland

[73] Assignee: Sandoz Ltd., Basel, Switzerland

[22] Filed: July 15, 1974

[21] Appl. No.: 488,636

[30] Foreign Application Priority Data

| | | |
|---|---|---|
| July 20, 1973 | Switzerland | 10645/73 |
| Feb. 20, 1974 | Switzerland | 2342/74 |

[52] U.S. Cl. ..... 8/178 R; 8/21 B; 8/54

[51] Int. Cl.[2] ..... D06P 3/24

[58] Field of Search ..... 8/178 R, 178 E, 21 B, 8/54

[56] References Cited

UNITED STATES PATENTS

| | | | |
|---|---|---|---|
| 1,948,568 | 2/1934 | Faber et al. | 8/2 |
| 3,468,620 | 9/1969 | Schaeuble et al. | 8/178 R |
| 3,762,860 | 10/1973 | Abrahams et al. | 8/21 A |
| 3,762,866 | 10/1973 | Rayment et al. | 8/149.1 |

FOREIGN PATENTS OR APPLICATIONS

| | | | |
|---|---|---|---|
| 1,134,221 | 11/1968 | United Kingdom | 8/2 |
| 428,655 | 7/1967 | Switzerland | 8/2 |
| 772,950 | 7/1967 | Belgium | 8/2 |

OTHER PUBLICATIONS

Abel et al., Textile–Prafis, Nov., 1967, (62), pp. 808–812.

Soiron et al., Textilveredlung 7, 1972, No. 1, pp. 24–27.

Matthews, Application of Dyestuffs, 1920, John Wiley & Sons, Inc., N.Y., pp. 398–400.

*Primary Examiner*—M. J. Welsh

*Attorney, Agent, or Firm*—Gerald D. Sharkin; Richard E. Vila; Joseph J. Borovian

[57] ABSTRACT

Disclosed is a process for dyeing or printing a voluminous textile substrate comprising natural or synthetic polyamide fibres, which process comprises applying to the substrate an aqueous dyeing or printing medium containing 0.05 to 100 g/l of a foaming agent, forming a foam on said substrate, rolling up the substrate and rotating the rolled up substrate for a period of from 1 to 48 hours at a temperature of from 20° to 60°C to effect fixation.

19 Claims, No Drawings

DYEING PROCESS

The invention relates to a textile dyeing or printing process, more particularly to a process for dyeing or printing voluminous textile substrates comprising or consisting of natural or synthetic polyamide fibres.

Thus, according to the invention, there is provided a process for dyeing or printing a voluminous textile substrate comprising natural or synthetic polyamide fibres, which process comprises applying to the substrate an aqueous dyeing or printing medium containing 0.05 to 100 g/l of a foaming agent, forming a foam on said substrate, rolling up the substrate and rotating the rolled up substrate for a period of from 1 to 48 hours at a temperature of from 20° to 60°C to effect fixation.

The term "voluminous textile substrate" is to be understood to include such textile substrates as velvets, pile fabrics, carpets, bulked substrates and substrates having a nap surface, carpets being of particular interest.

The preferred concentration of foaming agent in the medium is from 0.1 to 35 g/l, more preferably from 1 to 20 g/l.

A preferred liquor to goods ratio is from 0.5:1 to 10:1, more preferably from 1:1 to 8:1.

If desired, prior to application of the dyeing or printing medium, the substrate may be steamed. Such steaming preferably involves subjection of substrate to treatment with saturated steam at 100°C for a period of from 30 to 600 seconds, preferably from 30 to 180 seconds. Such treatment gives improved bulk.

The formation of the foam on the substrate may be carried out in any desired manner. For example, it may be formed by simply pouring a dye liquor containing the foaming agent onto the substrate, the foam being generated as the liquor hits the substrate, essentially by a splashing action. With a printing medium containing a foaming agent, the foam may be generated by applying pressure to the substrate after or during application of the printing medium, such pressure having a squeezing effect on the substrate, causing relative fibre/fibre movement and squeezing the printing medium through the fibre interstices. A preferred way of foam generation is to apply a mechanical action to the substrate, preferably a repeated mechanical action. Such action may be applied in any convenient way, essentially to cause relative fibre/fibre movement. A particularly preferred form of mechanical action is achieved by a massage-type operation, e.g. to cause successive compression and relaxation of the substrate. One way of performing such massage-type operation involves the passage of the substrate over guide rollers or through the nip of one or more pairs of rollers, the surfaces of which rollers, or at least one of which rollers in each pair, being preferably profiled, e.g. ribbed or burled, or perforated, so as to effect a rippling-like action on the fibres in the substrate. Where a pair of profiled rollers are employed, it is preferred that the profile pattern be such as to force lateral distribution of the medium across the substrate rather than build up at the nip between the rollers.

The formation of a foam, which is an essential feature of the present invention, facilitates distribution of the dyestuff into the substrate and build-up thereof on the surface of the substrate. Also, it enables the use of considerably reduced liquor to goods ratios over what would otherwise be required for the dyeing of voluminous substrates since the foam occupies greater volume than would a straight liquor. Further, the necessity of using thickening agents is reduced or at least lower amounts of thickening agent may be employed over what otherwise would be required since the foam itself has "body" and the ability to adhere to the substrate fibres. Thus, when applying a dye liquor, the amount of thickening agent may be considerably reduced or the agent omitted altogether, thus enabling liquors in a state of low viscosity to be applied initially to the substrate to achieve good penetration, whereafter formation of the foam increases the adherance of the liquor to the substrate fibres, thereby reducing the tendency of the liquor to leak from the substrate. The reduced amount of, or absence of, thickening agent is also of advantage in any subsequent washing of the substrate.

The foaming agent may be of the anionic, cationic, non-ionic or amphoteric type. The particular type of foaming agent used in a particular process would, of course, be chosen so as to be compatible with the dyestuff employed, e.g. where a cationic dyestuff is employed, a cationic, non-ionic or amphoteric foaming agent would be used. Particularly suitable foaming agents are given in Belgian Pat. Specification No. 772,950, the most preferred foaming agents being sodium lauryldiglycolether sulphate, octylphenyldecaglycolether, nonylphenylpentadecaglycolether, partially carboxymethylated laurylpentaglycolether, octylphenylpentaglycolether, sodium dioctylsulphosuccinate and ammonium-nonylphenyldiglycolether sulphate. The foam forming agents used are, of course, those which foam due to mechanical agitation as opposed to those which foam due to decomposition to yield a gaseous decomposition product.

After foam formation, the substrate may be rolled up by any desired means, preferably on a take-up roller or beam or similar device, care being taken to avoid undue creasing or wrinkling of the substrate.

The subsequent rotation of the rolled-up substrate may be about any axis, but is preferably about the longitudinal axis of the roll of fabric which itself is preferably in the horizontal or substantially horizontal plane. In the initial stages, the rotation serves, through the centrifugal force applied to the substrate and the constant effective change of direction of gravitational force, to cause the medium to permeate the fibre interstices and thereby maintain the foam and further ensure an even distribution of the medium throughout the substrate. As time elapses during the rotation, fixation takes place in like manner to conventional cold-retention processes. The rotation is preferably carried out for a period of from 2 to 24 hours. A preferred temperature is from 20°C to 40°C.

In the process of the invention, the distribution of the dye or printing liquor is promoted in two of the steps of operation, i.e. in the foam forming step, particularly where massage is carried out, and in the initial stages of the rotation step.

The speed of rotation is preferably kept low, e.g. of the order of from one-tenth to 20 r.p.m., preferably from 1 to 6 r.p.m. so as to avoid undue centrifugal force on the substrate so as to cause distortion thereof, particularly where the substrate is sensitive to tension or otherwise easily distorted.

After fixation has taken place, the substrate may be dried in conventional manner or, if desired, freed from any remaining liquor or liquor additive by washing or hydroextraction, it generally being sufficient to spray the substrate with a small amount of water and then to dry. Where the substrate is of differential polyamide and the dye used is anionic or cationic, special attention should be paid to the washing step. With such substrates, the washing preferably involves passage of the substrate through a rinsing bath at 20° to 80°C at a pH of from 3 to 5, preferably 4, for from 2 seconds to 5 minutes in order to improve reciprocal reserve.

Whilst the dyestuff used may be any dyestuff suitable for dyeing polyamide substrates by the cold retention process, e.g. an acid, dispersion or cationic dyestuff, the preferred dyestuffs for use in the present invention are the acid dyes, particularly such dyes of relatively low molecular weight, having preferably only one sulpho group and having relatively high affinity for polyamide fibres. Such dyes are known from the Colour Index and, with such dyes, build-up and levelness of the dyeings may easily be controlled by controlling the acidity of the medium from which the dye is applied. As examples of such dyes may be given C.I. Acid Yellow 174, C.I. Acid Orange 145, C.I. Acid Red 57, C.I. Acid Blue 72, C.I. Acid Red 151, C.I. Acid Blue 25, C.I. Acid Orange 127, C.I. Acid Red 299, C.I. Acid Blue 278, C.I. Acid Red 266, C.I. Acid Blue 288, C.I. Acid Blue 40 and Nylosan (Registered Trade Mark) Yellow C-RM.

With such dyes it is preferred to employ, in the dyeing or printing medium, an acid or substance capable of yielding an acid under the application condition. Of such acid-yielding substances, preference is given to such substances which give off the acid over a relatively prolonged period, thus allowing dye transfer from the medium to the substrate to be effected over a time span. This is of particular advantage when dyeings of good levelness are desired and when dyeing in light or midshades. As examples of such substances may be given succinimide, phthalimide, γ-butyrolactone and gluconic acid-delta-lactone. As examples of acids may be given acetic and formic acids, particularly the latter. Such acids are preferably employed in an amount of from 1 to 10 ml/l of medium.

In addition to the dyestuff, foaming agent and, where used, acid or acid yielding compound, the dyeing or printing medium may contain other conventional additives, such as electolytes for pH control, dyeing accelerators, carriers, retarding or levelling agents, dye bath stabilizers and, where required, thickening agents. It is of particular advantage to include a fixation accelerator, e.g. benzyl alcohol in an amount of from 1 to 40 ml/l, preferably 5 to 15 ml/l, of medium. Where an anionic dyeing assistant is employed, such is preferably employed in an amount of from 0.1 to 5% by weight of the substrate.

Care should be taken, particularly where low liquor to goods ratios are employed, to avoid premature drying of the medium on the substrate before satisfactory fixation has taken place. Where this tends to occur, the liquor to goods ratio should be increased or the fixation stage carried out in a moist atmosphere.

Where very deep shades are desired, the wet fastness properties thereof may be increased by passage of the substrate, after fixation and washing, through a bath containing 2 to 10 ml/l of formic or acetic acid at 30° to 80°C, the bath dwell time being from 5 to 300 seconds, the bath optionally containing additionally 0.5 to 10% of a commercial fixation agent for polyamides.

By the process of the invention, problems obtaining in prior art process can be obviated or alleviated. Thus, in prior art processes involving the application of heat to effect fixation, substrates having a nap or pile surface frequently suffer damage to the fibres by the heat treatment. Where thickening agents are used in relatively high amounts in prior art processes, the viscosity of the bath at the time of application is high and this can lead to irregular dispersion of the dyestuffs through the substrate. Similarly, the frequent occurring problem of "frosting" or "grey veil", which is caused by migration from the up-standing fibre tips of pile and similar fabrics of the dyestuff before fixation, is avoided by the surface build-up of foam in the present invention. Further, the relatively gentle mechanical treatment which can be used in the process of the present invention enables substrates sensitive to deformation to be dyed. Also, by the process of the invention, low liquor to goods ratios may be employed, thereby cutting down on the use of water and alleviating waste water disposal problems.

A surprising aspect of the process according to the present invention is the fact that textile surface formations which are sensitive to tension, pressure and deformation, such as tufted goods, Raschel goods or those produced by the weaving or needle technique, mainly carpets, may be dyed evenly, without deformation, either discontinuously or semi-continuously by the cold retention process, by using dyestuffs selected for this purpose, but especially those having a relatively low molecular weight, with a high yield of dye and sufficient fastness, which previously was hardly possible. Interesting multicoloured effects may be obtained with the process according to the invention when combining acid and dispersion dyestuffs or acid and cationic dyestuffs.

According to the process of the invention, natural polyamide fibre fabrics, such as those of wool, silk, nylon (6,66, etc.) as well as mixtures thereof, may be dyed or printed. The process is particularly suitable for dyeing synthetic polyamides of the nylon type, as well as the differential polyamides comprising these fibres. The mixed fabrics are preferably those containing more than 50% synthetic polyamides (e.g. 80% nylon/20% wool).

In the following Examples, the parts are by weight, and the parts by volume are related to the parts by weight as kg/l: the temperatures are given in degrees centigrade.

EXAMPLE 1

20,000 Parts of a velvet carpet of polyamide 6, tufted on a polypropylene backing, and having a square meter weight of 900 g, are placed in a wide casting mould into which is poured a dye bath with the following products therein:

0.9 parts of the dye C.I. Acid Orange 145
0.06 parts of the dye C.I. Acid Red 57
0.13 parts of the dye C.I. Acid Blue 72
1 part of a commercial thickener based on cellulose ether
5 parts of a commercial alkylphenylpolyglycolether
20 parts of acetic acid 80%

By pouring the liquor, a foam is developed. The bath absorption amounts to 250% in relation to the weight of the carpet.

Subsequently, the impregnated carpet is rolled up and rotated on a roll for 20 hours at 20° to 25° at 1 revolution per minute.

The carpet is then rinsed and dried. An even, well fixed dyeing is obtained, without the nap being permanently damaged.

EXAMPLE 2

100% of a printing paste (in relation to the weight of the goods to be printed) of the following composition is pressed onto a cut nap carpet of polyamide 6 by means of a printing stencil:

1.5 g/l of the dye C.I. Acid Orange 145
0.011 g/l of the dye C.I. Acid Red 57
0.025 g/l of the dye C.I. Acid Blue 25
10 g/l of a commercial thickener based on locust bean flour
15 ml/l of benzyl alcohol
3 g/l of a sulphated high fat alcohol (about C 12) polyglycolether (about 2 glycol radicals) (commercial goods)
5 ml/l of concentrated acetic acid The pressure applied when printing the substrate causes foam formation in the print paste. The printed goods are rolled up in a plastic sheet and rotated for 24 hours at room temperature whilst rolled. They are then washed briefly and dried.

By repeating the procedure of Example I but passing the carpet through a bath containing the liquor, and thereafter passing the carpet between the nip of a pair of surface profiled rollers prior to rolling up, a foam is formed on the carpet by the massage action of the rollers. The resulting dyed carpet is almost identical to that obtained in Example I.

What is claimed is:

1. A process for dyeing or printing a voluminous textile substrate comprising natural or synthetic polyamide fibers, which process comprises applying to the substrate an aqueous dyeing or printing medium containing 0.05 to 100 g/l of a foaming agent selected from the group consisting of anionic, cationic, non-ionic and amphoteric foaming agents, forming a foam on said substrate, rolling up the substrate and rotating the rolled up substrate for a period of from 1 to 48 hours at a temperature of from 20° to 60°C. to effect fixation.

2. The process of claim 1, wherein the concentration of foaming agent in the medium is from 0.1 to 35 g/l.

3. The process of claim 2, wherein the concentration of foaming agent in the medium is from 1 to 20 g/l.

4. The process of claim 1, wherein the ratio by weight of the dyeing or printing medium to the substrate is from 0.5 to 10:1.

5. The process of claim 4, wherein said ratio is from 1:1 to 8:1.

6. A process according to claim 1, wherein said medium is a dyeing medium in the form of a liquor, the foam being generated on the substrate by pouring the liquor, containing the foaming agent, onto the substrate.

7. A process according to claim 1, wherein said medium is a printing medium, the foam being generated on the substrate by applying pressure thereto during or after application of said medium.

8. A process according to claim 1, wherein the foam is formed on the substrate by subjection of the substrate, after application of said medium, to repeated mechanical action.

9. A process according to claim 8, wherein said mechanical action comprises a massaging action causing successive compression and relaxation of the substrate.

10. A process according to claim 9, wherein said massage action is performed by passage of the substrate through the nip of a pair of surface-profiled rollers or over one or more surface-profiled rollers.

11. A process according to claim 1, wherein the rotation of the rolled-up substrate is about the longitudinal axis of the roll of substrate, which axis is in the horizontal or substantially horizontal plane.

12. A process according to claim 1, wherein the rotation is carried out for a period of from 2 to 24 hours.

13. A process according to claim 1, wherein the rotation is carried out at a speed of from one-tenth to 20 r.p.m.

14. A process according to claim 13, wherein said speed is from 1 to 6 r.p.m.

15. A process according to claim 1, wherein the dyeing or printing medium comprises an acid dye.

16. A process according to claim 15, wherein said dye bears a single sulpho group and is of relatively low molecular weight.

17. A process according to claim 15, wherein said dyeing or printing medium comprises an acid or a compound yielding an acid under the dyeing conditions.

18. A process according to claim 17, wherein said dyeing or printing medium comprises a compound yielding an acid under the dyeing conditions, said compound being selected from succinimide, phthalimide, γ-butyrolactone and gluconic acid-delta-lactone.

19. A process according to claim 1, wherein the substrate is a carpet.

* * * * *